US009971285B2

(12) United States Patent
Okabe et al.

(10) Patent No.: US 9,971,285 B2
(45) Date of Patent: May 15, 2018

(54) IMAGE FORMING APPARATUS INCLUDING A WAVING MEMBER

(71) Applicant: FUJI XEROX CO., LTD., Tokyo (JP)

(72) Inventors: Koji Okabe, Kanagawa (JP); Shigeru Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/407,937

(22) Filed: Jan. 17, 2017

(65) Prior Publication Data

US 2017/0336739 A1 Nov. 23, 2017

(30) Foreign Application Priority Data

May 23, 2016 (JP) ..... 2016-102656

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2010/0254734 A1* 10/2010 Ishioka ..... B65H 5/062 399/322
2011/0076078 A1 3/2011 Yoshida
2013/0004221 A1* 1/2013 Honda ..... G03G 15/6502 399/400
2016/0251181 A1* 9/2016 Izumichi ..... B65H 5/36 271/225

FOREIGN PATENT DOCUMENTS

JP 2011-68451 A 4/2011

* cited by examiner

*Primary Examiner* — Victor Verbitsky
(74) *Attorney, Agent, or Firm* — Sughrue Mion, PLLC

(57) ABSTRACT

Provided is an image forming apparatus including a fixing member that transports a recording medium on which an image is transferred while nipping the recording medium to fix the image to the recording medium, a discharge member that discharges the recording medium by rotating forwardly, a guide member that guides the recording medium to a reverse transport path in which a front surface and a rear surface of the recording medium are reversed by coming in contact with the recording medium transported by the discharge member that reversely rotates, and a waving member that is disposed at a downstream side of the fixing member in the transport direction of the recording medium, and waves the recording medium transported by the fixing member in a width direction of the recording medium.

6 Claims, 12 Drawing Sheets

IMAGE FORMING APPARATUS INCLUDING A WAVING MEMBER

CROSS-REFERENCE TO RELATED APPLICATIONS

This application is based on and claims priority under 35 USC 119 from Japanese Patent Application No. 2016-102656 filed May 23, 2016.

BACKGROUND

Technical Field

The present invention relates to an image forming apparatus.

SUMMARY

According to an aspect of the invention, there is provided an image forming apparatus including:

a fixing member that transports a recording medium on which an image is transferred while nipping the recording medium to fix the image to the recording medium;

a discharge member that is disposed at a downstream side of the fixing member in a transport direction of the recording medium and discharges the recording medium by rotating forwardly;

a guide member that is disposed at an upstream side of the discharge member and a downstream side of the fixing member in the transport direction of the recording medium, and guides the recording medium to a reverse transport path in which a front surface and a rear surface of the recording medium are reversed by coming in contact with the recording medium transported by the discharge member that reversely rotates; and a waving member that is disposed at a downstream side of the fixing member in the transport direction of the recording medium, and waves the recording medium transported by the fixing member in a width direction of the recording medium.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
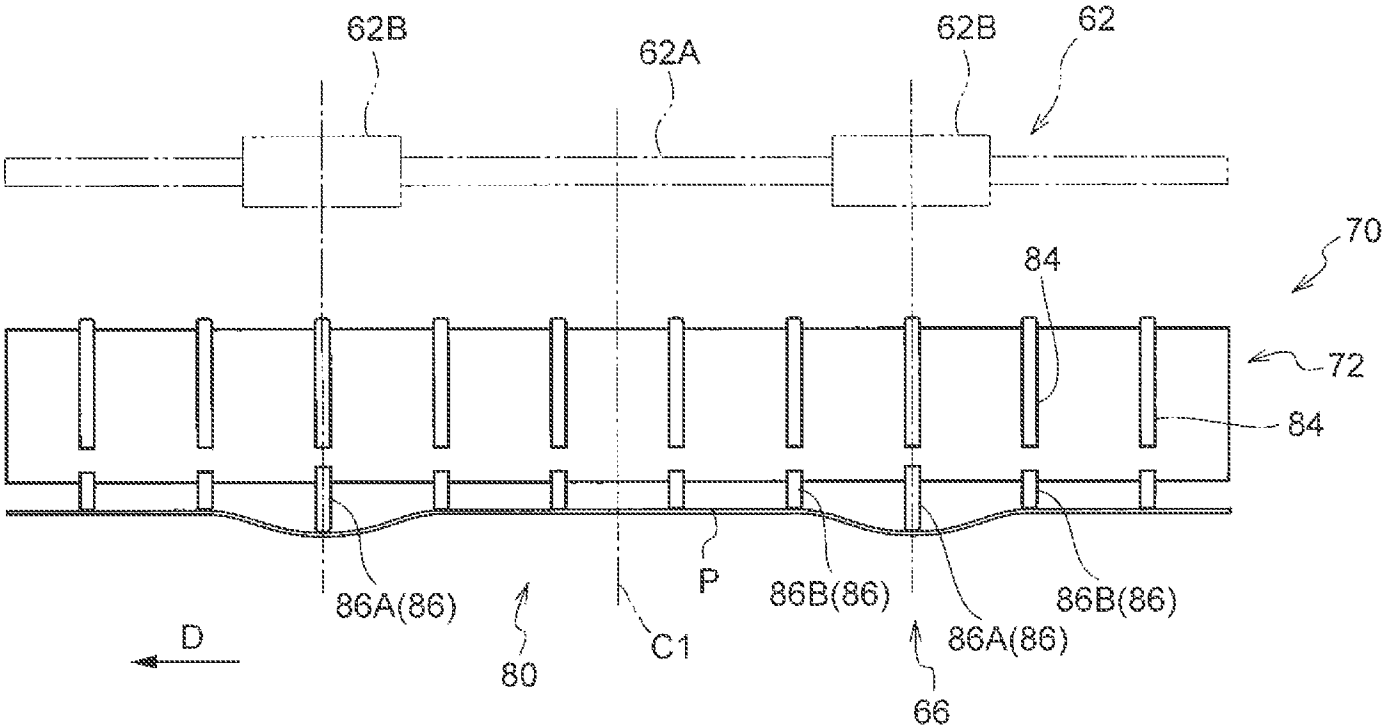
FIG. 1 is a front view illustrating a guide member provided in an image forming apparatus according to a first exemplary embodiment of the present invention.

An example of an image forming apparatus according to a first exemplary embodiment of the present invention will be described with reference to FIGS. 1 to 9. Here, the arrow H illustrated in the drawing indicates an apparatus up-and-down direction (a vertical direction), the arrow W indicates an apparatus width direction (a horizontal direction), and the arrow D indicates an apparatus depth direction (a horizontal direction).

(Overall Configuration)

Figure 9:
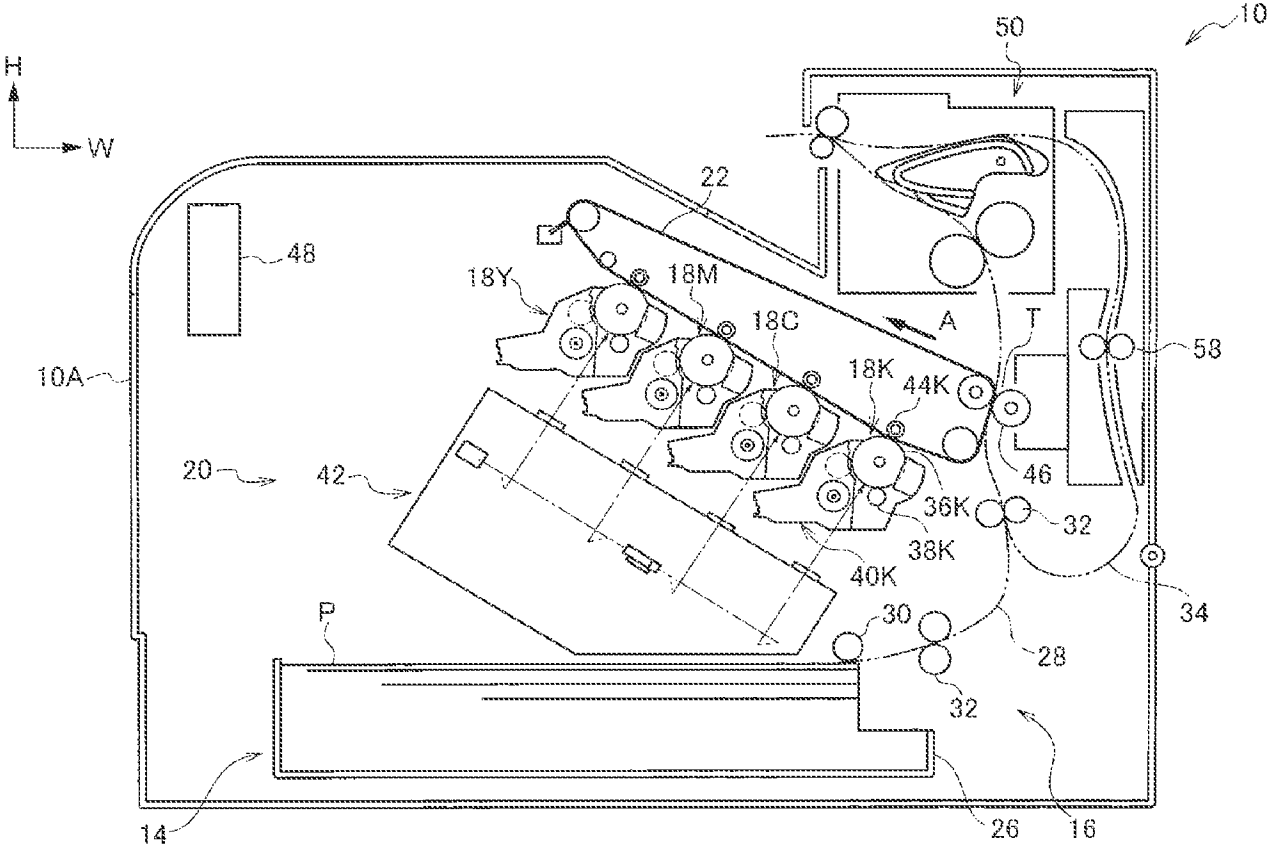
FIG. 9 is a schematic configuration diagram illustrating the image forming apparatus according to the first exemplary embodiment of the present invention.

As illustrated in FIG. 9, in an image forming apparatus 10 according to the first exemplary embodiment, an accommodating unit 14 that accommodates a sheet member P as a recording medium, a transport unit 16 that transports the sheet member P accommodated in the accommodating unit 14, and an image forming section 20 that forms an image on the sheet member P transported by the transport unit 16 from the accommodating unit 14 are provided in this order from the lower side to the upper side in the up-and-down direction (the arrow H direction).

The image forming apparatus 10 includes a controller 48 that controls respective units.

[Accommodating Unit]

The accommodating unit 14 includes an accommodating member 26 that may be drawn out from an apparatus body 10A of the image forming apparatus 10 forwards in the apparatus depth direction, and sheet members P are stacked on the accommodating member 26. The accommodating member 26 includes a delivery roller 30 that delivers the sheet members P stacked on the accommodating member 26 to a transport path 28 that configures the transport unit 16.

[Transport Unit]

The transport unit 16 includes plural transport rollers 32 which transport the sheet member P along the transport path 28 through which the sheet member P delivered from the accommodating unit 14 is transported.

Further, the transport unit 16 includes transport rollers 58 that transport the sheet member P along a reverse transport path 34 through which the sheet member P is transported when an image is to be formed on the rear surface of the sheet member P having an image formed on the front surface thereof.

[Image Forming Section]

The image forming section 20 includes four image forming units 18Y, 18M, 18C, and 18K for yellow (Y), magenta (M), cyan (C), and black (K). Here, when it is not necessary to differentiate Y, M, C, and K in the following description, Y, M, C, and K may be omitted in the description. The image forming section 20 includes an exposure device 42 that irradiates each of image carriers 36 provided in the image forming units 18 with exposure light.

Each of the image forming units 18 of respective colors is configured to be detachable from the apparatus body 10A. Then, the image forming unit 18 of each color includes the image carrier 36 and a charging member 38 that charges the surface of the image holding member 36. The image forming unit 18 of each color includes a developing device 40 that develops an electrostatic latent image formed on the charged image holding member 36 through emission of the exposure light by the exposure device 42, and visualizes the electrostatic latent image as a toner image.

The image forming section 20 includes an endless-type transfer belt 22 that circulates in the arrow A direction in the drawing, and a primary transfer roller 44 that transfers the toner image, which has been formed by the image forming unit 18 of each color, to the transfer belt 22. Further, the image forming section 20 includes a secondary transfer roller 46 that transfers the toner image, which has been transferred to the transfer belt 22, to the sheet member P, and a fixing unit 50 that heats and presses the sheet member P to which the toner image has been transferred so that the toner image is fixed to the sheet member P.

Details of the fixing unit 50 will be described below.

(Operation of Image Forming Apparatus)

In the image forming apparatus 10, an image is formed in the following manner.

First, a charging member 38 of each color, to which a voltage is applied, uniformly and negatively charges the surface of the image carrier 36 of each color at a predetermined potential. Subsequently, based on image data received from the outside, the exposure device 42 irradiates the charged surface of the image carrier 36 of each color with exposure light to form an electrostatic latent image.

Accordingly, the electrostatic latent image corresponding to the data is formed on the surface of the image carrier 36 of each color. The developing device 40 of each color develops the electrostatic latent image so as to visualize the electrostatic latent image as a toner image. The toner image formed on the surface of the image carrier 36 of each color is transferred to the transfer belt 22 by the primary transfer roller 44.

Therefore, a sheet member P delivered from the accommodating member 26 to the transport path 28 by the delivery roller 30 is delivered to a transfer position T where the transfer belt 22 and the secondary transfer roller 46 come in contact with each other. At the transfer position T, the sheet member P is transported while being interposed between the transfer belt 22 and the secondary transfer roller 46, so that the toner image on the surface of the transfer belt 22 is transferred to the front surface of the sheet member P.

The toner image transferred to the front surface of the sheet member P is fixed to the sheet member P by the fixing unit 50. Then, the sheet member P to which the toner image is fixed is discharged to the outside of the apparatus body 10A by a discharge roller 62 (details thereof will be described later) rotating in the forward direction.

Meanwhile, when a toner image is to be formed on the rear surface of the sheet member P, the sheet member P having the toner image fixed to the front surface thereof is delivered to the reverse transport path 34 by the discharge roller 62 (details thereof will be described later) rotating in the reverse direction. Then, in a state where the front and rear surfaces of the sheet member P are reversed, the sheet member P is delivered to the transport path 28. Thereafter, a process of forming the toner image on the rear surface of the sheet member P is the same as the above described process of forming the toner image on the front surface of the sheet member P.

(Configuration of Main Parts)

Next, the fixing unit 50 will be described.

Figure 2:
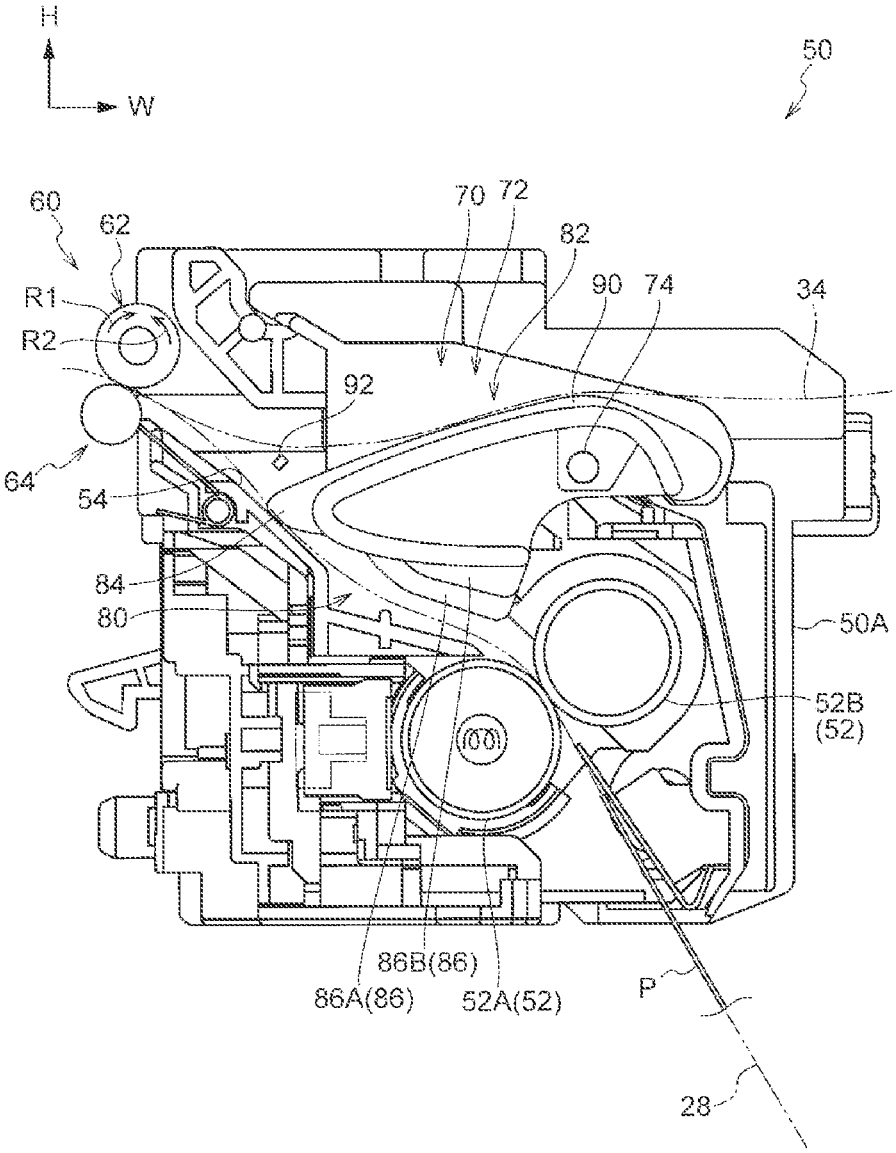
FIG. 2 is a side view illustrating a fixing unit provided in the image forming apparatus according to the first exemplary embodiment of the present invention.

The fixing unit 50 is configured to be detachable from the apparatus body 10A. As illustrated in FIG. 2, the fixing unit 50 includes a fixing member 52 that fixes the toner image to the sheet member P, and a guide member 70 that guides the sheet member P that is being transported. The fixing unit 50 further includes a discharge unit 60 that discharges the sheet member P to the outside of the apparatus body 10A (see FIG. 9), and a housing 50A that supports respective units. The transport path 28 of the sheet member P passes through the inside of the housing 50A.

[Fixing Member]

The fixing member 52 is disposed at the upstream side portion of the transport direction of the sheet member P (hereinafter, referred to as "sheet transport direction"). The fixing member 52 includes a heating roller 52A having a heat source provided therein and is rotatably driven, and a pressurizing roller 52B that is disposed opposite to the heating roller 52A across the transport path 28 to pressurize the sheet member P being transported toward the heating roller 52A. The pressurizing roller 52B is configured to come in contact with the heating roller 52A and rotate following the rotating heating roller 52A.

In the configuration described above, when the heating roller 52A rotates to transport the sheet member P to which the toner image is transferred while the sheet member P is being nipped between the heating roller 52A and the pressurizing roller 52B, the fixing member 52 fixes the toner image to the sheet member P.

[Discharge Unit]

The discharge unit 60 is disposed at the downstream side portion in the sheet transport direction in the transport path 28 within the housing 50A. The discharge unit 60 includes the discharge roller 62 as an example of a rotating discharge member, and a driven roller 64 that is disposed opposite to the discharge roller 62 across the transport path 28 to rotate following the rotating discharge roller 62.

Figure 8:
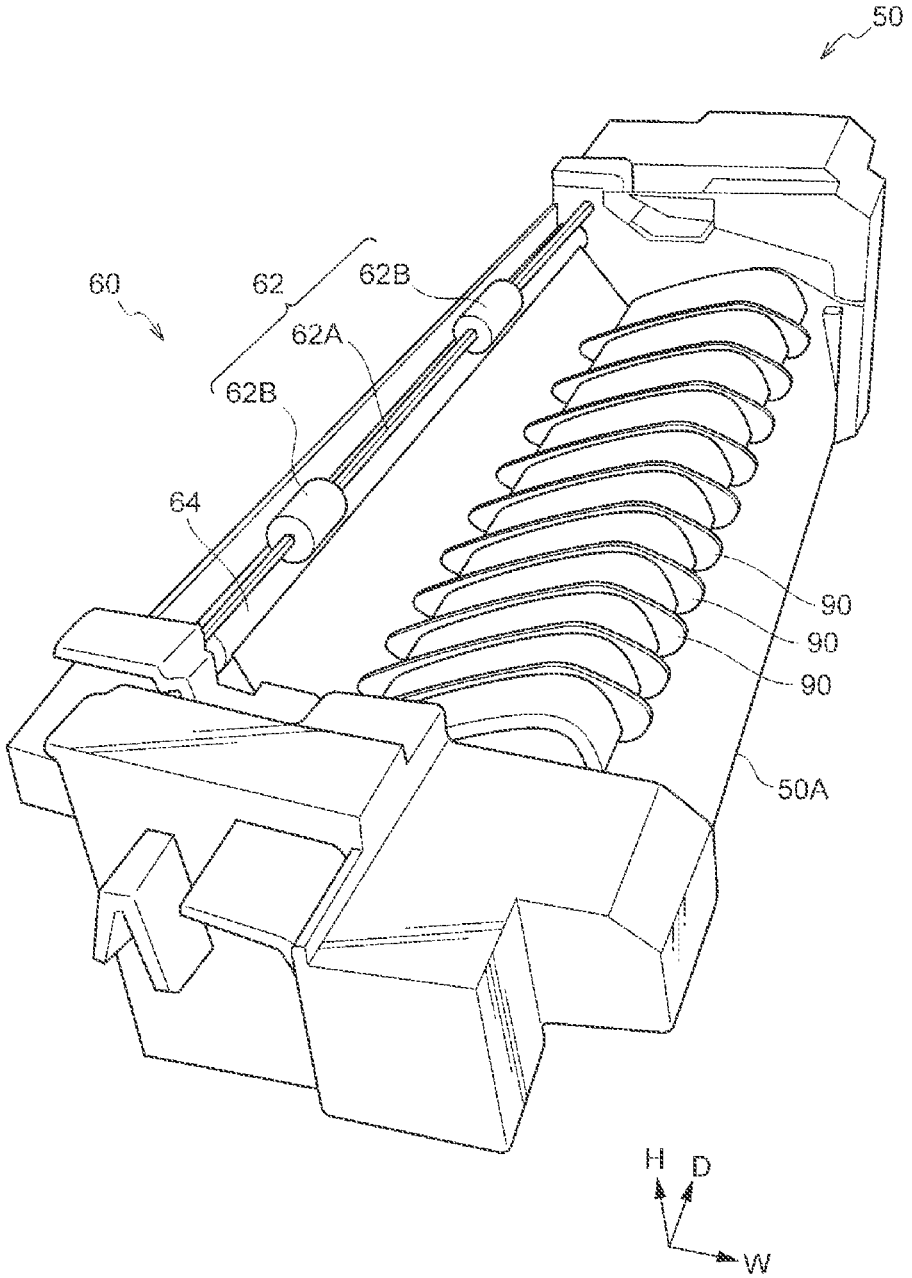
FIG. 8 is a perspective view illustrating the fixing unit provided in the image forming apparatus according to the first exemplary embodiment of the present invention.

As illustrated in FIG. 8, the discharge roller 62 includes a shaft member 62A that extends in the apparatus depth direction, and two rubber rollers 62B which are attached to the shaft member 62A to be spaced apart from each other in the apparatus depth direction, and are larger in a diameter than the shaft member 62A. The rubber rollers 62B are an example of a cylindrical member, and are disposed at a symmetrical position with respect to a central portion of the discharge roller 62 in the apparatus depth direction.

In the configuration described above, the discharge roller 62 that rotates in the forward direction (R1 direction of FIG. 2) transports the sheet member P while the sheet member P is nipped between the discharge roller 62 and the driven roller 64 such that the discharge unit 60 discharges the sheet member P to the outside of the apparatus body 10A (see FIG. 9). The discharge roller 62 that rotates in the reverse direction (R2 direction of FIG. 2) transports the sheet member P while the sheet member P is nipped between the discharge roller 62 and the driven roller 64 such that the discharge unit 60 transports the sheet member P toward the reverse transport path 34.

[Housing]

The housing 50A supports respective units as described above. In the housing 50A, as illustrated in FIG. 2, a guiding surface 54 that guides the sheet member P transported by the fixing member 52 toward the discharge unit 60 is formed.

Specifically, when viewed in the apparatus depth direction, the guiding surface 54 is disposed on the left side in the drawing with respect to the transport path 28.

[Guide Member]

The guide member 70 is disposed on the downstream side in the sheet transport direction with respect to the fixing member 52, and disposed on the upstream side in the sheet transport direction with respect to the discharge unit 60. The guide member 70 is disposed to face the guiding surface 54 of the housing 50A with respect to the transport path 28, on the right side in the drawing, when viewed in the apparatus depth direction. The guide member 70 includes a main body portion 72, and a shaft member 74 whose axial direction is the apparatus depth direction and which swingably supports the main body portion 72. The shaft member 74 is disposed in a portion of the main body portion 72 which is distant from the transport path 28.

In this configuration, the main body portion 72 swings around the shaft member 74 so as to move between a first position (see FIG. 4) where the fixing member 52 conveys the sheet member P toward the discharge unit 60, and a second position (see FIG. 5) where the discharge unit 60 conveys the sheet member P toward the reverse transport path 34. When abutting against the guiding surface 54 due to the own weight of the main body portion 72, the main body portion 72 moves to the second position. When pushed by the sheet member P being transported, the main body portion 72 moves to the first position.

A portion of the main body portion 72, which faces the transport path 28, serves as a first guide portion 80 that guides the sheet member P transported by the fixing member 52 toward the discharge unit 60. A portion of the main body portion 72, which faces upwards, serves as a second guide portion 82 that guides the sheet member P transported by the discharge roller 62 rotating in the reverse direction (R2 direction in FIG. 2) toward the reverse transport path 34. In the main body portion 72, the front side portion in the apparatus depth direction and the back side portion in the apparatus depth direction are symmetrical to each other with respect to the central portion in the apparatus depth direction.

Figure 7:
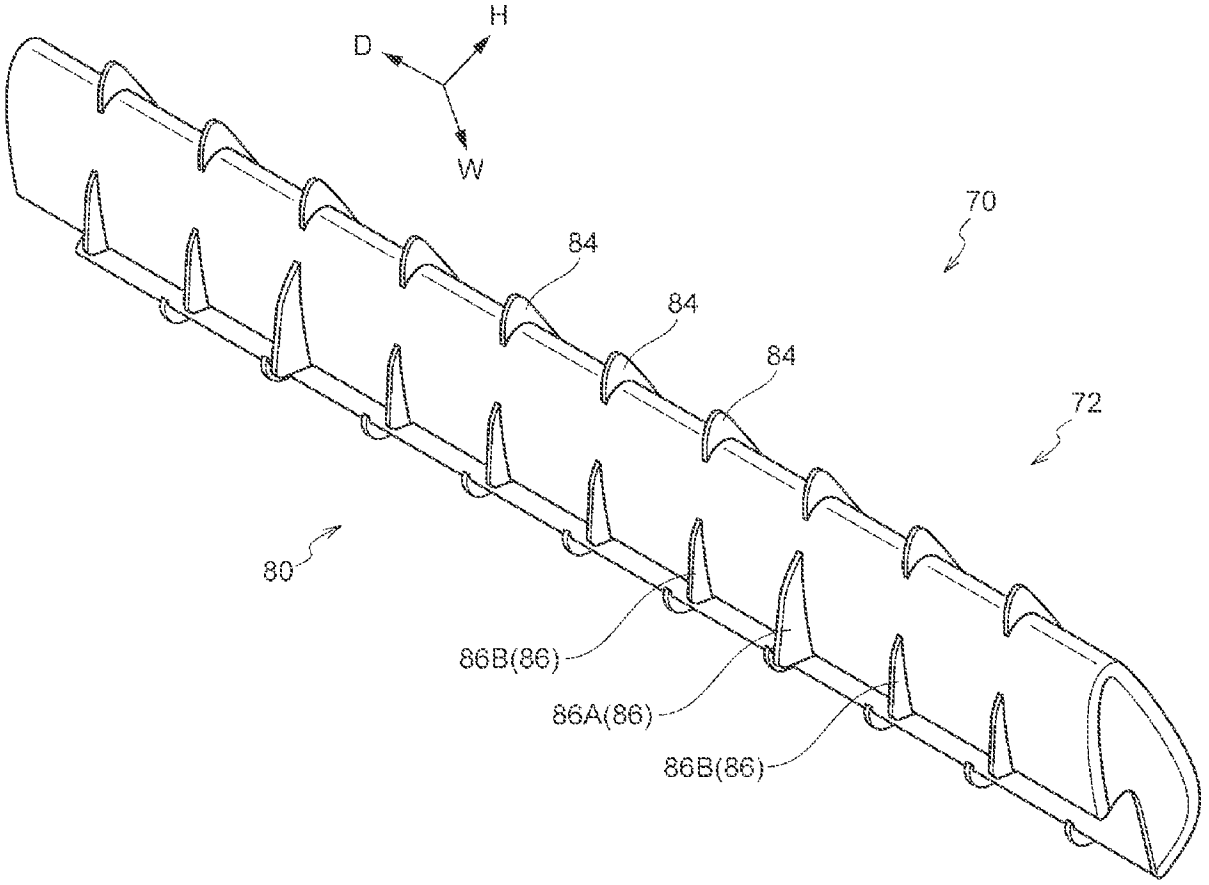
FIG. 7 is a perspective view illustrating the guide member provided in the image forming apparatus according to the first exemplary embodiment of the present invention.

As illustrated in FIGS. 2 and 7, the first guide portion 80 includes a rib 84 having a plate shape and formed on the downstream side portion in the sheet transport direction, and a rib 86 as an example of a plate member that is formed on the upstream side portion in the sheet transport direction.

Plural ribs 84 are formed to be spaced apart from each other in the apparatus depth direction such that plate surfaces are set in the apparatus depth direction (in the same direction as the width direction of the sheet member P to be transported). In the plural ribs 84, protruding amounts protruding from the basic surface of the first guide portion 80 toward the sheet member P are equal to each other. When the main body portion 72 is disposed at the second position, the ribs 84 abut on the guiding surface 54 (see FIG. 2).

Plural ribs 86 are formed to be spaced apart from each other in the apparatus depth direction such that plate surfaces are set in the apparatus depth direction. A part of the plural ribs 86 are ribs 86A, as an example of a first plate member, and the other part of the plural ribs 86 are ribs 86B having a protruding amount different from that of the ribs 86A, as an example of a second plate member. The ribs 86A are larger, in the protruding amount, than the ribs 86B, and two ribs 86A are formed. The plural ribs 86B are formed in the apparatus depth direction with each rib 86A being interposed therebetween. In the sheet transport direction, a difference in the protruding amount between the rib 86A and the rib 86B (the dimension F in FIG. 4) is equal in the linear portion.

In the apparatus depth direction, the pitch between the ribs 86A is equal to the pitch between the two rubber rollers 62B of the discharge roller 62 as illustrated in FIG. 1. Here, a pitch (an interval between members) indicates a pitch centered on the center line of (the center line C1 in FIG. 1) of the fixing unit 50 (see FIG. 2) in the apparatus depth direction.

In this configuration, the sheet member P transported by the fixing member 52 is guided to the discharge unit 60, while the rear surface (one surface) of the sheet member P abuts against protruding ends (end surfaces) of the ribs 86 and the ribs 84. Here, since the protruding amount of the rib 86A is different from the protruding amount of the rib 86B, the sheet member P is waved in the apparatus depth direction (see FIG. 1). Here, the term "waved" indicates that the sheet member P becomes uneven when viewed in the transport direction.

As described above, the rib 86A and the rib 86B serve as waving members 66 that wave the sheet member P.

Further, the second guide portion 82 includes plural ribs 90 which are formed to be spaced apart from each other in the apparatus depth direction such that plate surfaces are set in the apparatus depth direction, as illustrated in FIGS. 2 and 8. Protruding amounts of the plural ribs 90 are equal to each other.

Figure 6:
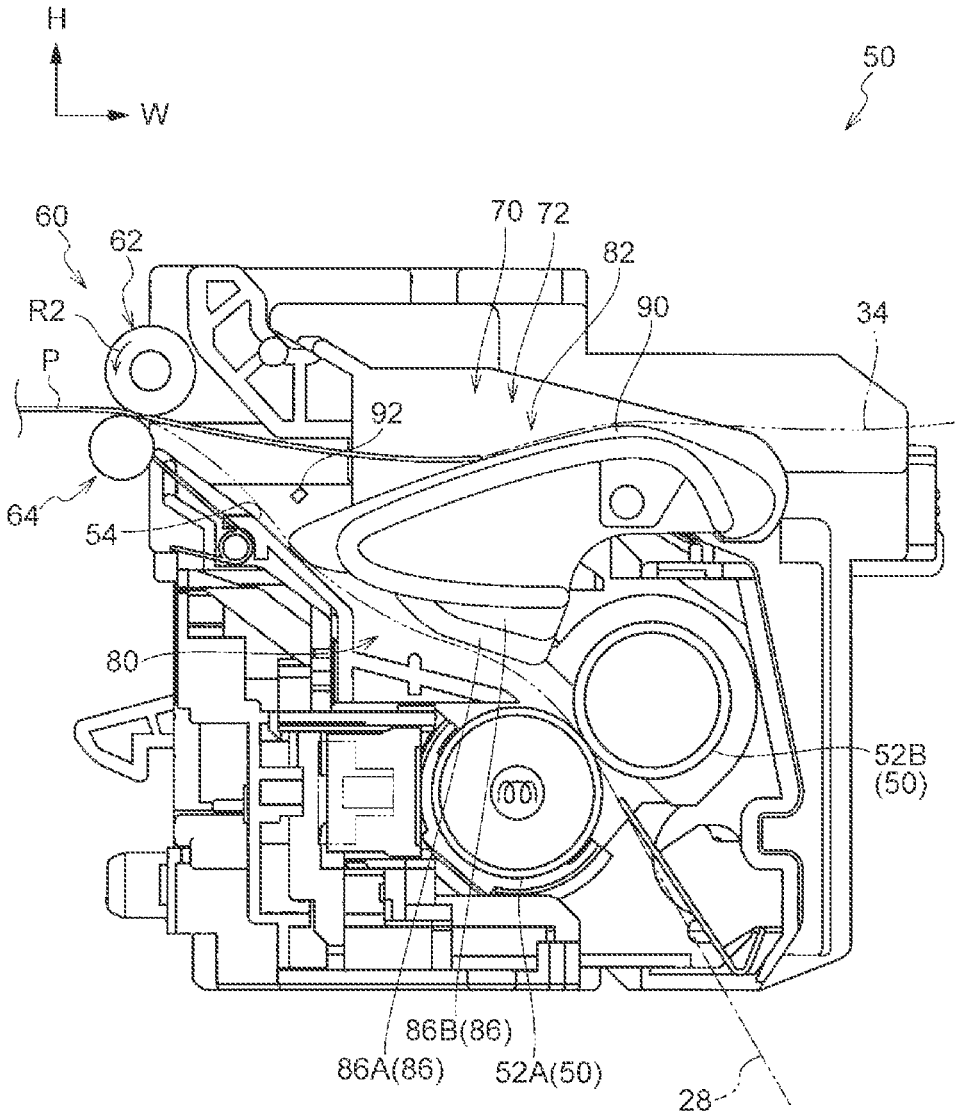
FIG. 6 is a side view illustrating the fixing unit provided in the image forming apparatus according to the first exemplary embodiment of the present invention.

In this configuration, the sheet member P, which is being transported by the discharge roller 62 rotating in the reverse direction, is guided toward the reverse transport path 34 by abutting against the protruding ends of the ribs 90 to be curved, as illustrated in FIG. 6.

[Others]

A sensor 92 that detects the passage of the sheet member P transported by the fixing member 52 is disposed on the downstream side of the guide member 70 and on the upstream side of the discharge unit 60 in the sheet transport direction, as illustrated in FIG. 2.

(Operation)

Hereinafter, operations of configurations of main parts will be described. Here, the main body portion 72 of the guide member 70 abuts against the guiding surface 54 due to the own weight, and thus is disposed at the second position.

As illustrated in FIG. 2, the heating roller 52A rotates to transport the sheet member P having the toner image transferred to the front surface thereof while the sheet member P is nipped between the heating roller 52A and the pressurizing roller 52B. Accordingly, the fixing member 52 fixes the toner image to the front surface of the sheet member P.

The rear surface (a surface on which no image is formed) at the leading end side of the sheet member P transported to the downstream side in the sheet transport direction by the fixing member 52 abuts against the protruding ends of the ribs 86 of the guide member 70, and the sheet member P is guided to the downstream side in the sheet transport direction by the fixing member 52.

Figure 3:
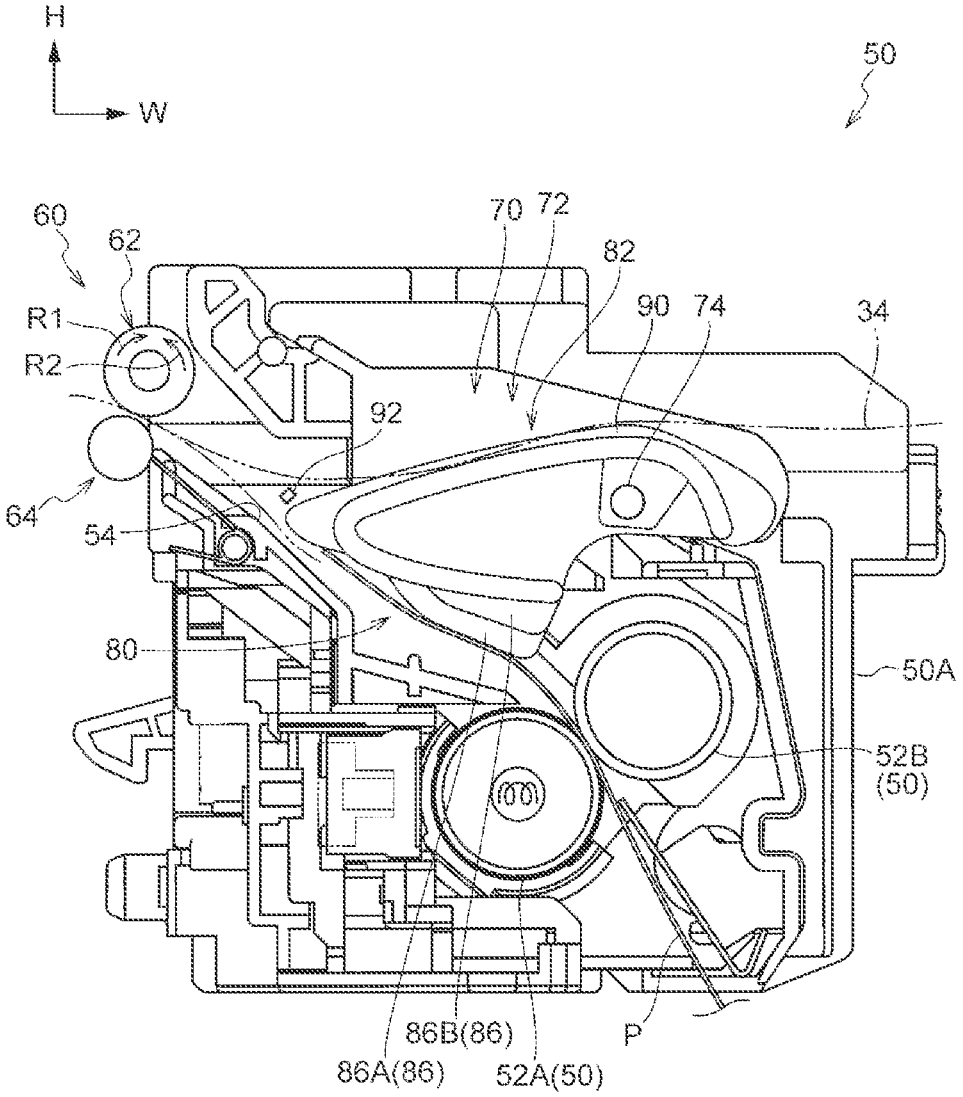
FIG. 3 is a side view illustrating the fixing unit provided in the image forming apparatus according to the first exemplary embodiment of the present invention.
Figure 4:
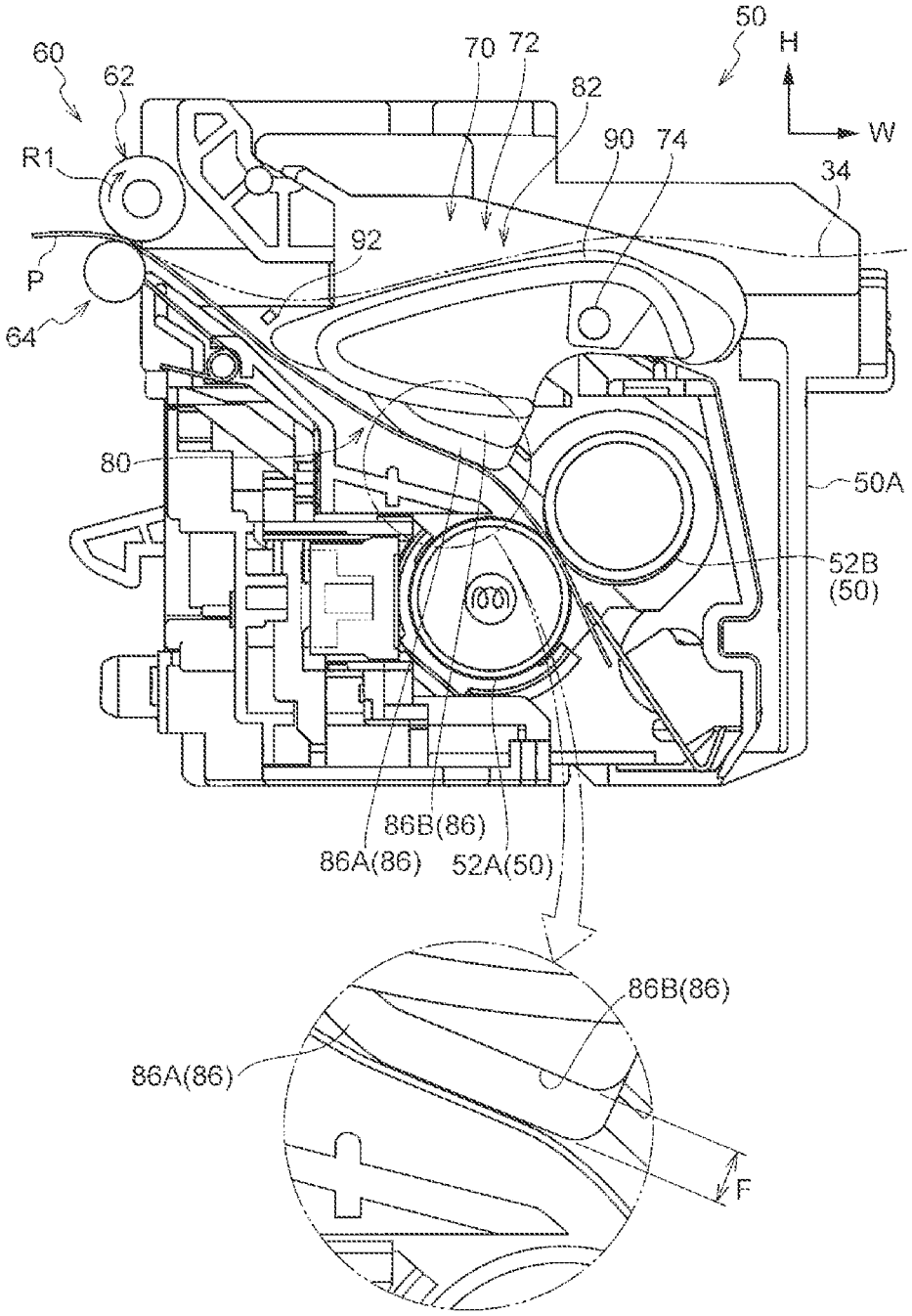
FIG. 4 is a side view illustrating the fixing unit provided in the image forming apparatus according to the first exemplary embodiment of the present invention.

When the rear surface of the transported sheet member P abuts against the protruding ends (end surfaces) of the ribs 86, the main body portion 72 is pushed by the transported sheet member P, thereby swinging around the shaft member 74. Then, as illustrated in FIGS. 3 and 4, the main body portion 72 is separated from the guiding surface 54, and moves to the first position.

Here, when the rear surface comes in contact with the protruding ends of the ribs 86, the sheet member P is waved in the apparatus depth direction (the width direction of the sheet member P), as illustrated in FIG. 1. That is, the angle of the sheet member P transported by the fixing member 52 is determined so that the sheet member P comes in contact with protruding ends of the ribs 86A and the ribs 86B. Accordingly, the bending rigidity of the sheet member P in the sheet transport direction is increased (the stiffness becomes strong). The discharge roller 62 that rotates in the forward direction (R1 direction in FIG. 4) transports the sheet member P to which the toner image is fixed while the sheet member P is nipped between the discharge roller 62 and the driven roller 64.

In a case where any image is not to be formed on the rear surface of the sheet member P, the discharge roller 62 rotating in the forward direction discharges the sheet member P as it is to the outside of the apparatus body 10A. Here, since the sheet member P to be discharged is high in the bending rigidity, the sheet member P is discharged to the outside of the apparatus body 10A in a state of a stable posture.

Figure 5:
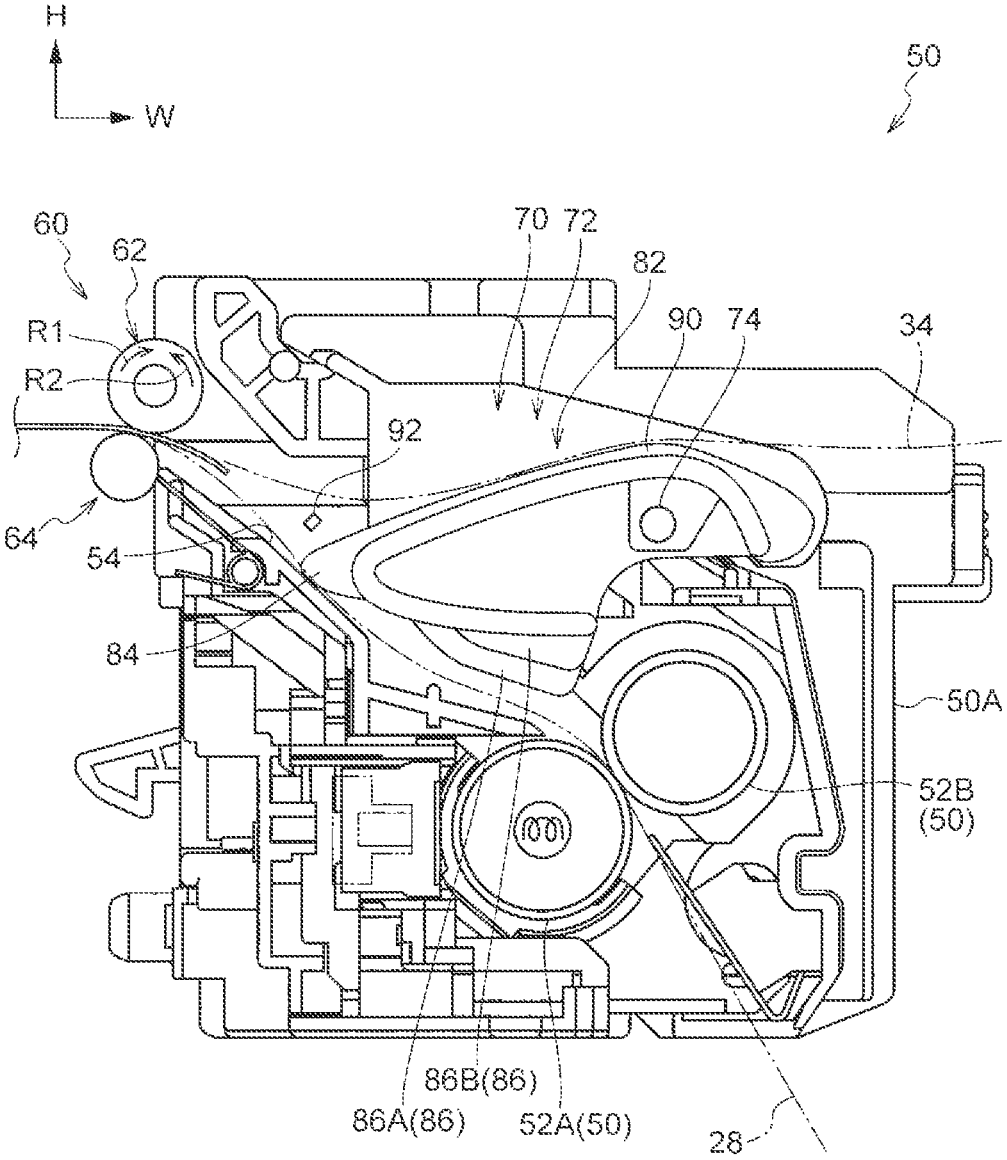
FIG. 5 is a side view illustrating the fixing unit provided in the image forming apparatus according to the first exemplary embodiment of the present invention.

Meanwhile, in a case where a toner image is to be formed on the rear surface of the sheet member P, when the sensor 92 detects the passage of the sheet member P, the controller 48 (see FIG. 9) rotates the discharge roller 62 rotating in the forward direction, in the reverse direction (R2 direction in FIG. 5). Here, the main body portion 72 of the guide member 70 disposed at the first position swings due to the own weight and moves to the second position, as illustrated in FIG. 5, as the sheet member P passes.

The discharge roller 62 that rotates in the reverse direction, as illustrated in FIG. 6, transports the sheet member P having the toner image fixed to the front surface thereof while the sheet member P is nipped between the discharge roller 62 and the driven roller 64. The sheet member P transported by the discharge roller 62 rotating in the reverse direction abuts against the protruding ends of the ribs 90 of the second guide portion 82, and is transported toward the reverse transport path 34.

Here, the sheet member P is not waved in the apparatus depth direction, and is not high in the bending rigidity in the sheet transport direction (the stiffness is lowered). Thus, the transported sheet member P is curved along the ribs 90 and further transported toward the reverse transport path 34.

In a case of a comparative embodiment where the sheet member P is waved by a discharge unit, the sheet member P transported by the discharge unit is high in the rigidity, and thus may be folded without being curved along the ribs 90, resulting in clogging.

As the front and rear surfaces of the sheet member P transported along the reverse transport path 34 are reversed, the toner image is formed on the rear surface of the sheet member P.

(Summary)

As described above, the sheet member P transported by the discharge roller 62 rotating in the reverse direction does not abut against the ribs 86 and thus is not waved in the apparatus depth direction. Thus, the bending rigidity of the sheet member P in the sheet transport direction is lowered (the stiffness becomes weak).

Since the bending rigidity of the sheet member P is lowered, the sheet member P being transported is curved along the ribs 90 and further transported toward the reverse transport path 34. This suppresses the sheet member P from being clogged (jammed). That is, as compared to a case where the discharge roller causes the sheet member P to be waved, the sheet member P is suppressed from being clogged when the sheet member P is transported toward the reverse transport path.

The rear surface (one surface) of the sheet member P is allowed to abut against the ribs 86, and thus is waved. Therefore, for example, as compared to a case where the sheet member P is waved by being nipped between two components, the number of components is reduced.

The ribs 86 configure the first guide portion 80 of the main body portion 72. Thus, as compared to a case where the ribs 86 are separately provided, the number of components is reduced.

In the sheet transport direction, a difference in the protruding amount between the rib 86A and the rib 86B (the dimension F in FIG. 4) is equal. Thus, as compared to a case where the difference in the protruding amount changes, the waved shape of the sheet member P is stabilized.

In the apparatus depth direction, the pitch between the ribs 86A is equal to the pitch between the two rubber rolls 62B of the discharge roller 62 as illustrated in FIG. 1. Thus, as compared to a case where the rubber rollers 62B are provided entirely in the apparatus depth direction, the waved shape of the sheet member P discharged from the discharge roller 62 is maintained.

Second Exemplary Embodiment

An example of an image forming apparatus according to a second exemplary embodiment of the present invention will be described with reference to FIG. 10. Here, descriptions on the second exemplary embodiment will be made mainly focusing on parts different from those in the first exemplary embodiment.

Figure 10:
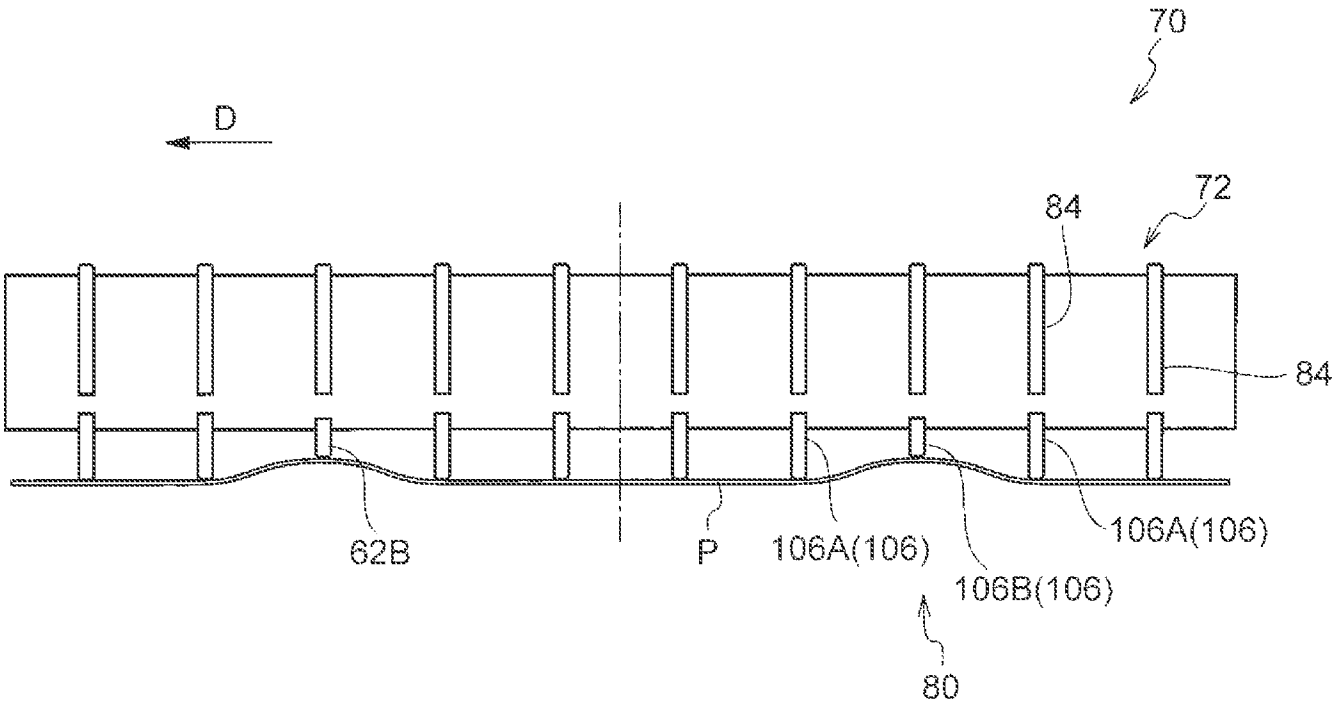
FIG. 10 is a front view illustrating a guide member provided in an image forming apparatus according to a second exemplary embodiment of the present invention.

As illustrated in FIG. 10, a first guide portion 80 includes a rib 84 having a plate shape and formed on the downstream side portion in the sheet transport direction, and a rib 106 as an example of a plate member that is formed on the upstream side portion in the sheet transport direction.

Plural ribs 106 are formed to be spaced apart from each other in the apparatus depth direction such that plate surfaces are set in the apparatus depth direction. The ribs 106 include ribs 106A as an example of a first plate member and ribs 106B as an example of a second plate member, in which the ribs 106A and the ribs 106B are different from each other in the protruding amount protruding toward the transported sheet member P. The ribs 106B are smaller in the protruding amount than the ribs 106A, and two ribs 106B are formed. The plural ribs 106A are formed in the apparatus depth direction with each rib 106B being interposed therebetween.

In the apparatus depth direction, the pitch between the two ribs 106B is equal to the pitch between the rubber rolls 62B.

In this configuration, the sheet member P being transported by the fixing member 52 is guided toward the discharge unit 60 by abutting against the protruding ends of the ribs 106 and the ribs 104. Here, since the protruding amount of the rib 106A is different from the protruding amount of the rib 106B, the sheet member P abutting against the ribs 106 is waved in the apparatus depth direction.

Other operations are the same as those in the first exemplary embodiment.

Third Exemplary Embodiment

Figure 11:
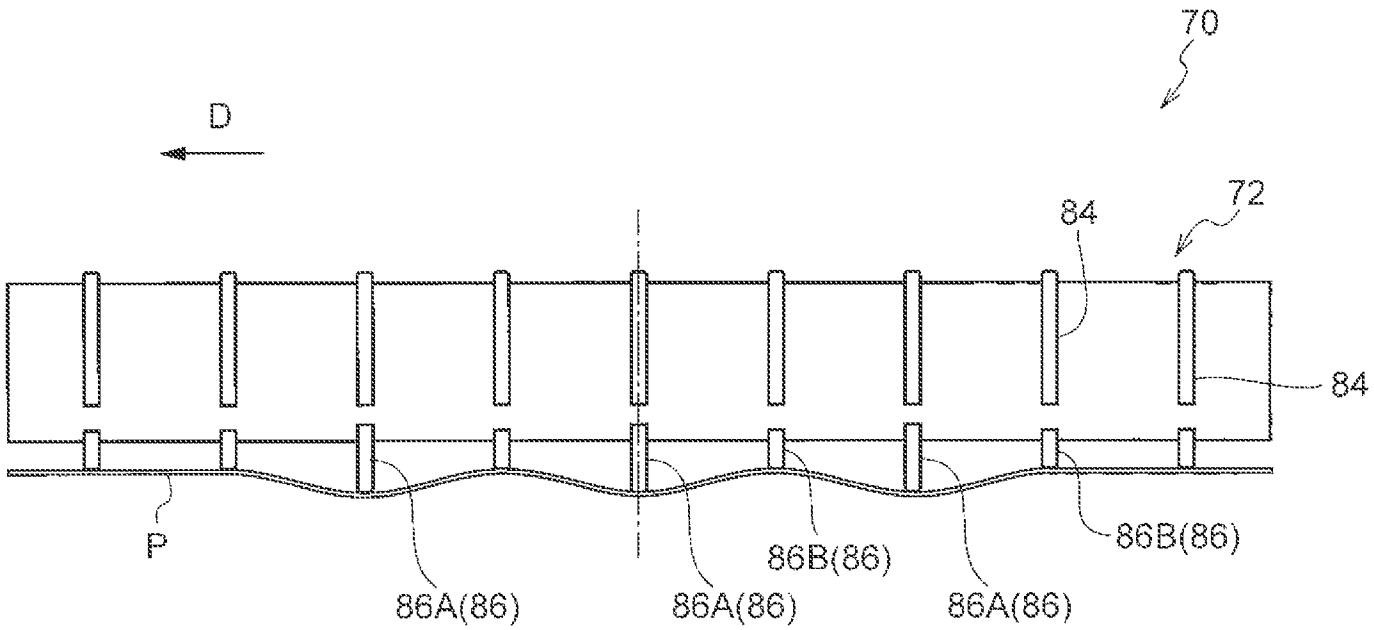
FIG. 11 is a front view illustrating a guide member provided in an image forming apparatus according to a third exemplary embodiment of the present invention.

An example of an image forming apparatus according to a third exemplary embodiment of the present invention will be described with reference to FIG. 11. Here, descriptions on the third exemplary embodiment will be made mainly focusing on parts different from those in the first exemplary embodiment.

A rib 86A in the third exemplary embodiment is also formed at the center side portion of the main body portion 72 in the apparatus depth direction. In this manner, three ribs 86A are formed.

In this configuration, since the three ribs 86A are formed, the number of waves of the sheet member P is larger as compared to a case where two ribs 86A are formed.

Other operations are the same as those in the first exemplary embodiment.

Fourth Exemplary Embodiment

An example of an image forming apparatus according to a fourth exemplary embodiment of the present invention will be described with reference to FIG. 12. Here, descriptions on the fourth exemplary embodiment will be made mainly focusing on parts different from those in the first exemplary embodiment.

Figure 12:
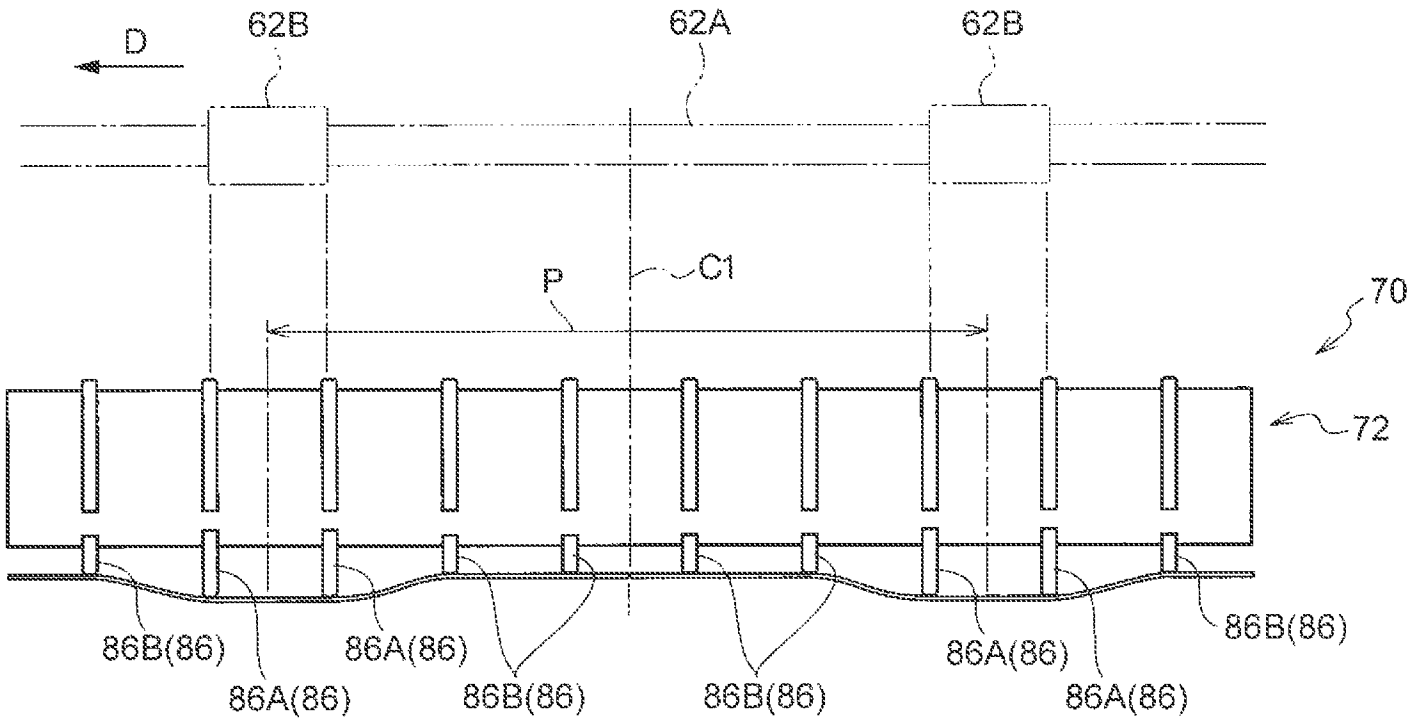
FIG. 12 is a front view illustrating a guide member provided in an image forming apparatus according to a fourth exemplary embodiment of the present invention.

As illustrated in FIG. 12, two ribs 86A are formed to be aligned at the left side portion in the drawing, and two ribs 86A are formed to be aligned at the right side portion in the drawing. Plural ribs 86B are formed in the apparatus depth direction with two ribs 86A being interposed therebetween.

In the apparatus depth direction, the ribs 86A are disposed at the positions corresponding to both end portions of each of the two rubber rollers 62B of the discharge roller 62. In the apparatus depth direction, a pitch between a pair of ribs 86A at one side and a pair of ribs 86A at the other side is equal to a pitch between the two rubber rollers 62B of the discharge roller 62, as illustrated in FIG. 12. Here, the pitch between the pair of ribs 86A at one side and the pair of ribs 86A at the other side corresponds to a distance from the center of the pair of ribs 86A at one side in the apparatus depth direction to the center of the pair of the ribs 86A at the other side in the apparatus depth direction.

Other operations are the same as those in the first exemplary embodiment.

The present invention has been described in detail with respect to specific exemplary embodiments, but is not limited by the exemplary embodiments. It is apparent to those skilled in the art that other various exemplary embodiments may be adopted within the scope of the present invention. For example, in the exemplary embodiments described above, the ribs 86, or the ribs 106 configure the first guide portion 80 of the guide member 70, but the ribs 86 or the ribs 106 may be configured as separate components from the guide member 70. In this case, the effect obtained by the ribs 86 or the ribs 106 configuring the first guide portion 80 is not obtained.

In the above described exemplary embodiments, although not specifically described, a configuration in which the protruding amounts of the ribs 86 or the ribs 106 are changed may be adopted. For example, the ribs 86 and the ribs 106 may be configured to be individually replaceable, so that the protruding amounts of the ribs 86 and the ribs 106 may be changed. Further, a known slide mechanism may be provided so as to change the protruding amounts of the ribs 86 and the ribs 106. In this case, the protruding amounts of the ribs 86 and the ribs 106 are changed according to a paper quality of the sheet member P.

In the above described exemplary embodiments, two types of ribs having different protruding amounts may be used to wave the sheet member P, but three or more types of ribs having different protruding amounts may be used to wave the sheet member P.

In the above described exemplary embodiments, as the waving members 66, the ribs 86 are used, but, for example, a transport surface on which the sheet member P is transported may be waved in the width direction of the sheet member P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing member configured to transport a recording medium while nipping the recording medium to fix an image to the recording medium;

a discharge member that is disposed at a downstream side of the fixing member in a transport direction of the recording medium and is configured to discharge the recording medium by rotating forwardly;

a guide member that is disposed at an upstream side of the discharge member and the downstream side of the fixing member in the transport direction of the recording medium, wherein the guide member is configured to guide the recording medium to a reverse transport path by contacting the recording medium transported by the discharge member, which reversely rotates, and wherein in the reverse transport path, a front surface and a rear surface of the recording medium are reversed; and a waving member that is disposed at the downstream side of the fixing member in the transport direction of the recording medium, and is configured to wave the recording medium transported by the fixing member in the width direction of the recording medium, wherein the waving member includes a plurality of plate members that are arranged to be spaced apart from each other in the width direction such that plate surfaces face in the width direction, each of the plate members having an end surface configured to come in contact with one surface of the recording medium that is being transported, and protruding amounts of the plate members protruding toward the recording medium being different from each other, wherein the guide member includes:

a first guide portion configured to guide the recording medium transported by the fixing member toward the discharge member by coming in contact with the recording medium, and a second guide portion configured to guide the recording medium transported by the discharge member that reversely rotates toward the reverse transport path by coming in contact with the recording medium;

wherein the plate members configure the first guide portion, wherein the second guide portion comprises a plurality of ribs, and wherein protruding amounts of each one of the plurality of ribs are equal to each other.

2. The image forming apparatus according to claim 1, wherein protruding amounts of the plate members are changeable.

3. The image forming apparatus according to claim 1, wherein some of the plurality of plate members are first plate members, and the remaining plate members of the plurality of plate members are second plate members that are smaller, in the protruding amount, than the first plate members, and wherein a difference in the protruding amount between the first plate members and the second plate members is equal to each other in the transport direction of the recording medium.

4. The image forming apparatus according to claim 2, wherein some of the plurality of plate members are first plate members, and the remaining plate members of the plurality of plate members are second plate members that are smaller, in the protruding amount, than the first plate members, and wherein a difference in the protruding amount between the first plate members and the second plate members is equal to each other in the transport direction of the recording medium.

5. The image forming apparatus according to claim 1, wherein the discharge member includes:

a shaft member that extends in the width direction; and two cylindrical members which are spaced apart from each other in the width direction and which are configured to allow the shaft member to pass through, wherein the plurality of plate members include at least two or more types of plate members having different protruding amounts, in which a pitch of one type of plate members in the width direction, among the two or more types of plate members, is equal to a pitch of the cylindrical members in the width direction, and wherein the one type of plate members and the cylindrical members overlap each other in the transport direction of the recording medium.

6. The image forming apparatus according to claim 2, wherein the discharge member includes:

a shaft member that extends in the width direction; and two cylindrical members which are spaced apart from each other in the width direction and which are configured to allow the shaft member to pass through, and wherein the plurality of plate members include at least two or more types of plate members having different protruding amounts, in which a pitch of one type of plate members in the width direction, among the two or more types of plate members, is equal to a pitch of the cylindrical members in the width direction, and wherein the one type of plate members and the cylindrical members overlap each other in the transport direction of the recording medium.

* * * * *